US006686893B2

(12) United States Patent
Lin et al.

(10) Patent No.: US 6,686,893 B2
(45) Date of Patent: Feb. 3, 2004

(54) DUAL BAND ANTENNA

(75) Inventors: Hsien Chu Lin, Tu-Chen (TW); Chieh-Chao Yu, Tu-Chen (TW); Yung-Chien Chung, Tu-Chen (TW); Lung-Sheng Tai, Tu-Chen (TW)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 59 days.

(21) Appl. No.: 10/032,247

(22) Filed: Dec. 21, 2001

(65) Prior Publication Data

US 2003/0080905 A1 May 1, 2003

(30) Foreign Application Priority Data

Oct. 26, 2001 (TW) ..... 90218394 U

(51) Int. Cl.[7] ..... H01Q 9/28
(52) U.S. Cl. ..... 343/828; 343/795; 343/806
(58) Field of Search ..... 343/702, 700 MS, 343/895, 795, 806, 828

(56) References Cited

U.S. PATENT DOCUMENTS 6,473,044 B2 * 10/2002 Manteuffel et al. ..... 343/702

* cited by examiner

*Primary Examiner*—Michael C. Wimer
(74) *Attorney, Agent, or Firm*—Wei Te Chung

(57) ABSTRACT

A dual band antenna (1) includes a printed wiring board (PWB) (20). The PWB has an antenna trace (10) and a grounding plate (30) respectively disposed on opposite surfaces (20*a*, 20*b*) of the PWB. The antenna trace includes a radiating arm (100) and a matching means (13). The radiating arm includes a meandering segment (12) and a linking segment (11). The linking segment links two points of the meandering segment, thereby forming a closed loop. Because of the closed loop, the radiating arm has two transmission paths, one longer path, which does not include the linking segment, and one shorter path, which does include the linking segment. The dual band antenna, therefore, is capable of operating at two different frequency bands because of the two paths of the radiating arm.

4 Claims, 3 Drawing Sheets

| | Frequency(GHZ) | SWR |
|---|---|---|
| 1 | 2.40 | 2.2842 |
| 2 | 2.45 | 1.5182 |
| 3 | 2.50 | 1.0272 |
| 4 | 5.15 | 1.8367 |
| 5 | 5.25 | 1.7619 |

DUAL BAND ANTENNA

FIELD OF THE INVENTION

The present invention relates to a dual band antenna, and more particularly, to a dual band antenna having a single radiating arm operating at dual frequency bands.

BACKGROUND OF THE INVENTION

With the current developments in communication technology, many electronic devices need to receive and transmit signals in dual frequency ranges. The electronic devices, therefore, need to have dual band antennas operating in dual frequency ranges. U.S. Pat. No. 6,166,694 discloses a dual band antenna. The conventional dual band antenna includes two radiating arms which are of different lengths and which are capable of being tuned to different frequency bands. However, each radiating arm of the conventional antenna is only resonant at one frequency band. The radiating arms occupy a relatively large space. Furthermore, if an electrical device needs a conventional antenna to operate at multiple frequency bands, the antenna has to have an additional radiating arm for each additional frequency band. These radiating arms must occupy extra printed board space and may result in complex shapes. These multiple radiating arms are also disadvantageous when a designer has to decrease the size of the antenna.

The present invention is directed to an improved dual band antenna having a single radiating arm with a closed loop, which operates at dual frequency bands, which obviates adding extra radiating arms, which prevents occupation of extra space.

BRIEF SUMMARY OF THE INVENTION

A main object of the present invention is to provide a dual band antenna with a single radiating arm for operating at dual frequency bands.

A dual band antenna in accordance with the present invention comprises a printed wiring board (PWB) having opposite first and second surfaces, with an antenna trace disposed on the first surface, and with a grounding plate disposed on the second surface of the PWB. The antenna trace includes a radiating arm and a matching means extending from the radiating arm. The radiating arm includes a meandering segment and a linking segment. The meandering segment includes a plurality of U-shaped bends. The linking segment is provided to short cut one of the U-shaped bends, thereby forming a closed loop. Because of the closed loop, the radiating arm has two transmission paths, one longer path, which does not include the linking segment, and one shorter path, which does include the linking segment. The dual band antenna, therefore, is capable of operating at two different frequency bands along two paths of the single radiating arm.

Other objects, advantages and novel features of the invention will become more apparent from the following detailed description when taken in conjunction with the accompanying drawings.

DETAILED DESCRIPTION OF THE INVENTION

Figure 1:
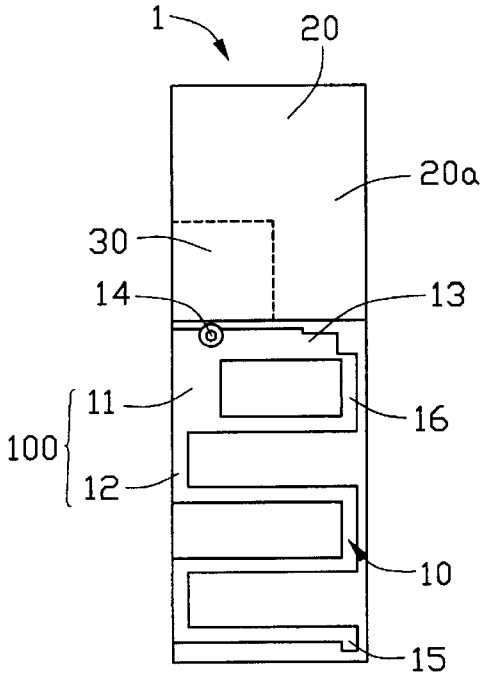
FIG. 1 is a top view of a dual band antenna of the present invention.
Figure 2:
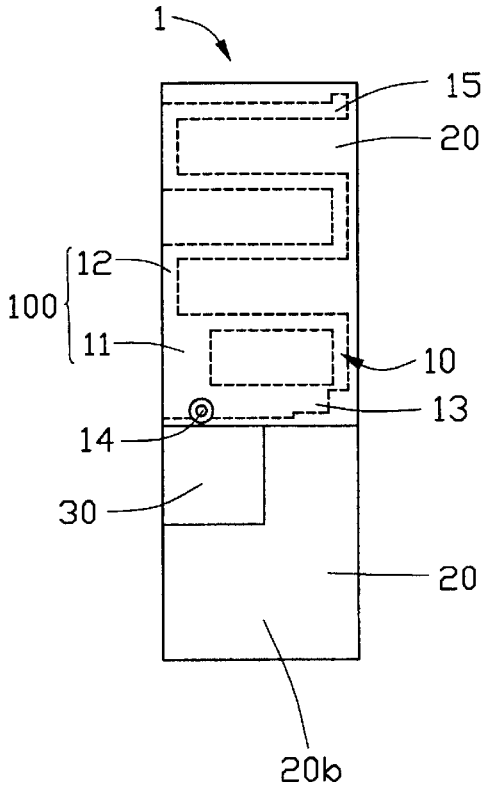
FIG. 2 is a bottom view of the dual band antenna of FIG. 1.

As shown in FIGS. 1 and 2, a dual band antenna 1 according to the present invention comprises a printed wiring board (PWB) 20, a conductive antenna trace 10 and a grounding plate 30.

The PWB 20 is substantially rectangular and comprises opposite first and second surfaces 20*a*, 20*b*. The antenna trace 10 is disposed on the first surface 20*a* and comprises a single radiating arm 100 and a matching means 13 extending from the radiating arm 100. The radiating arm 100 includes a meandering segment 12 and a linking segment 11. The meandering segment 12 extends serpentineformly along the first surface 20*a*, forming a plurality of U-shaped bends (not labeled). The meandering segment 12 includes a free end 15 and a feed point 14 defined at opposite ends thereof. The feed point 14 is defined through the PWB 20. The linking segment 11 extends between uppermost points (not labeled) of two adjacent arms (not labeled) of a U-shaped bend, thereby sealing an opening (not labeled) of the U-shaped bend to form a closed loop (not labeled). In this preferred embodiment, the linking segment 11 is disposed at an endmost U-shaped bend 16 which includes the feed point 14 along one of its arms (not labeled). Impedance matching of the dual band antenna 1 is performed by the matching means 13. By adjusting the dimension, shape and position of the matching means 13, the impedance of the dual band antenna 1 can be changed. The grounding plate 30 is disposed on the second surface 20*b* of the PWB 20 and is spaced a distance from the feed point 14 along a longitudinal direction of the second surface 20*b*.

A cable, which is provided to transmit signals between the antenna 1 and a signal processing circuit (not shown, since such circuits are well known in the art), comprises a conductive core wire and a conductive ground shield around the core wire. The core wire is inserted through the PWB 20 at the feed point 14, from the second surface 20*b* to the first surface 20*a*, and is soldered to the antenna trace 10 on the first surface 20*a*. The ground shield connects with the grounding plate 30 on the second surface.

The dual band antenna 1 has two transmission paths for transmitting and/or receiving signals. In this embodiment, a first path is along the meandering segment 12, i.e. the first path begins at the feed point 14 and extends along every U-shaped bend and ends at the free end 15 of the meandering segment 12. A second path begins at the feed point 14 and extends along the linking segment 11, and then extends along every U-shaped bend of the meandering segment 12 except the U-shaped bend 16, and ends at the free end 15. The two transmission paths of the dual band antenna 1 are of different lengths. The resonant frequency band of the antenna 1 is primarily determined by the length of the antenna trace 10. By controlling the lengths of the first and second paths, the dual band antenna 1 is capable of operating at two different frequency bands using the single radiating arm 100. The first path is of a first length (generally a quarter wavelength of a frequency band to which the first path is to be tuned) and is constructed to be resonant at frequencies in the first band, and the second path is of a second length and is constructed to be resonant at frequencies in a second band.

Figure 4:
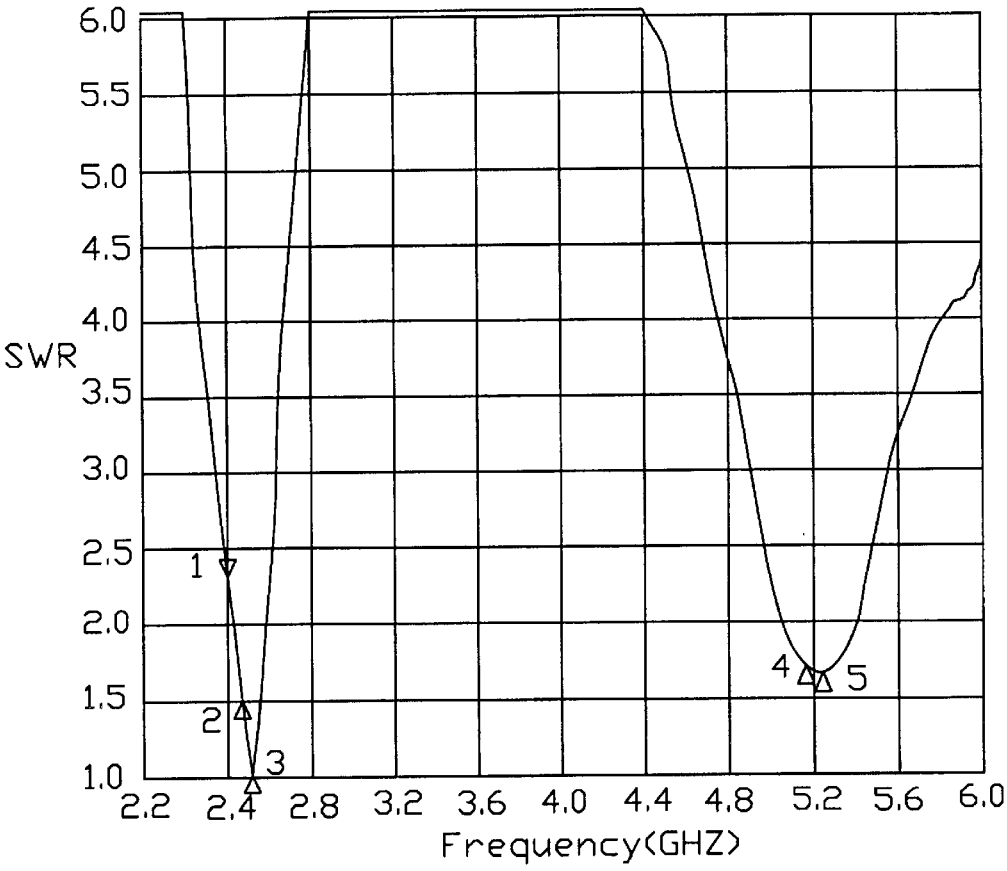
FIG. 4 is a test graph and table obtained from the dual band antenna of FIG. 1, disclosing Standing Wave Ratio (SWR) varying with frequency.

When the embodiment of the present invention shown in FIGS. 1 and 2 was under testing, data correlating SWR to frequency was collected, as is shown in the graph and table of FIG. 4. In particular, values given in the table include test values of SWR at the frequencies 2.4 GHz, labeled as point 1 on the graph, at 2.45 GHz, labeled as point 2, at 2.5 GHz, labeled as point 3, at 5.15 GHz, labeled as point 4, and at 5.25 GHz, labeled as point 5. These test values of SWR include those at low frequencies (such as 2.45 GHz) and high frequencies (such as 5.15 GHz) for normal use of this antenna embodiment. The graph shows that the standing wave ratios (SWR) of the four points 2, 3, 4 and 5 are under the value 2, which is substantially desired. Even the SWR at point 1 is near the value 2.

Figure 3A:
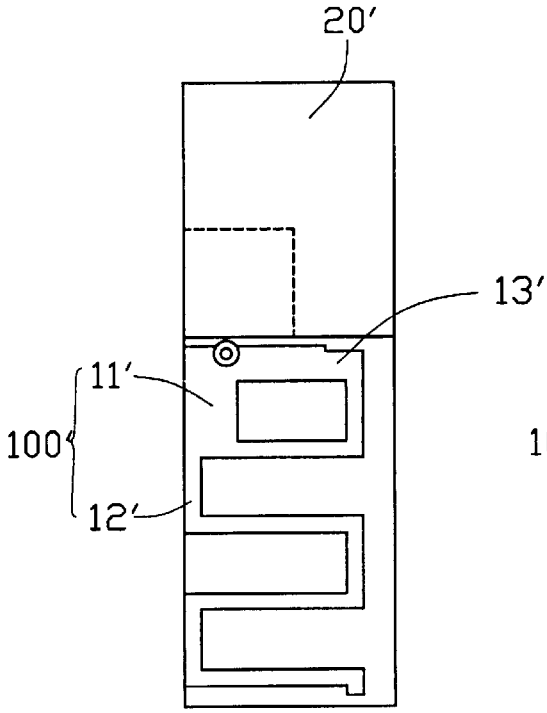
FIGS. 3A and 3B respectively illustrate two other embodiments of the present invention for application in different environments.
Figure 3B:
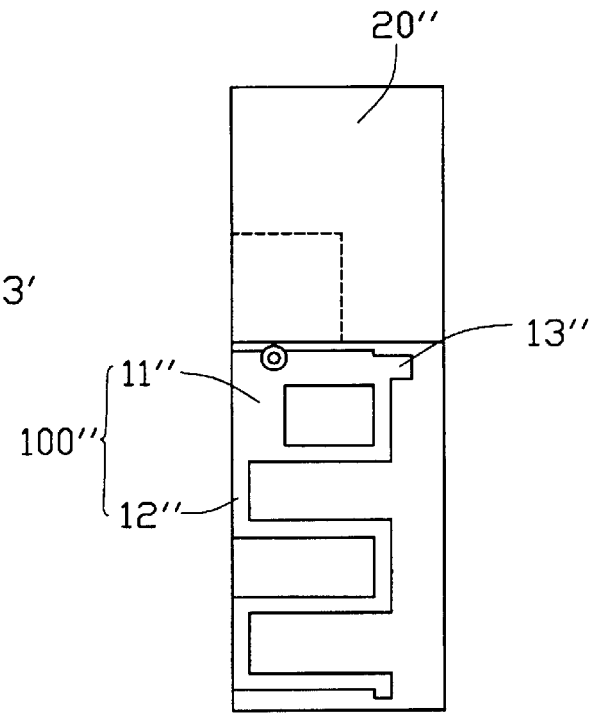

In use, the dual band antenna 1 is mounted in an electronic device and can communicate in two different frequency bands. In order to suit different electronic devices and to obtain the best communications, the present invention may have different embodiments which have different dimensions and shapes. FIGS. 3A and 3B show two other embodiments of the present invention, very similar to the embodiment shown in FIGS. 1 and 2, for applications in different electronic devices. Note that the length of each U-shaped bend is less in FIG. 3A than in FIG. 1, and is less yet in FIG. 3B than in FIG. 3A. Of course, other dimensions, and shapes, can be varied, as well.

The radiating arm 100 of the dual band antenna 1 may form more than one closed loops by including additional linking segments 11 at openings of two or more U-shaped bends of the meandering segment 12. With more linking segments, the dual band antenna 1 will have more than two transmission paths, and can operate at more than two frequency bands.

The invention is advantageously used in any wireless network where spatial reuse of the channel is possible, for example in systems following the Institute of Electrical and Electronics Engineers (IEEE) 802.11a and IEEE 802.11b standards.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multiple band antenna comprising:

a printed wiring board (PWB) comprising opposite first and second surfaces;

an antenna trace disposed on the first surface of the PWB and comprising a radiating arm and a feed point, said radiating arm comprising a meandering segment and at least one linking segment, said at least one linking segment linking at least two points of said meandering segment to form at least one closed loop, thereby forming at least two transmission paths, said at least two transmission pats being of different lengths, and operating frequencies of the multiple band antenna being primarily determined by the lengths of said at least two transmission paths, said feed point defined through said PWB; and a grounding plate disposed on the second surface of the PWB.

2. The multiple band antenna as claimed in claim 1, wherein said meandering segment comprises a plurality of U-shaped bends, and wherein said at least one linking segment short cuts at least one of said U-shaped bends.

3. The multiple band antenna as claimed in claim 2, wherein said at least two transmission paths comprise a first path and a second path, the first path beginning at said feed point, extending along every U-shaped bend, and ending at a free end of the said meandering segment, the second path beginning at said feed point, extending along said at least one linking segment and every U-shaped bend of said meandering segment excepting said at least one U-shaped which is short cut by said at least one linking segment, and ending at said free end of said meandering segment.

4. A multiple band antenna comprising:

a printed wiring board (PWB) comprising opposite first and second surfaces;

an antenna trace disposed on the first surface of the PWB and comprising a radiating arm and a feed point, said radiating arm comprising a meandering segment and at least one linking segment, said at least one linking segment linking at least two points of said meandering segment to form at least one closed loop, thereby forming at least two transmission paths, said feed point defined through said PWB; and a grounding plate disposed on the second surface of the PWB.

* * * * *